US007044870B2

(12) United States Patent
Pagotto

(10) Patent No.: US 7,044,870 B2
(45) Date of Patent: May 16, 2006

(54) BLADE FOR HOCKEY STICK OR THE LIKE

(75) Inventor: John Pagotto, 336 Woodlea avenue, Mount Royal, Quebec (CA) H3P 1R5

(73) Assignee: John Pagotto, Mount-Royal (CA)

( * ) Notice: Subject to any disclaimer, the term of this patent is extended or adjusted under 35 U.S.C. 154(b) by 0 days.

(21) Appl. No.: 11/004,912

(22) Filed: Dec. 7, 2004

(65) Prior Publication Data

US 2005/0101422 A1 May 12, 2005

Related U.S. Application Data

(62) Division of application No. 09/784,213, filed on Feb. 16, 2001, now abandoned.

(60) Provisional application No. 60/183,159, filed on Feb. 17, 2000.

(51) Int. Cl.
*A63B 59/14* (2006.01)

(52) U.S. Cl. ..... 473/563

(58) Field of Classification Search ..... 473/560–563
See application file for complete search history.

(56) References Cited

U.S. PATENT DOCUMENTS

| | | | | |
|---|---|---|---|---|
| 2,912,245 | A | | 11/1959 | Gardner et al. |
| 3,561,760 | A | | 2/1971 | Klay |
| 4,013,288 | A | * | 3/1977 | Goverde ..... 473/562 |
| 4,358,113 | A | * | 11/1982 | McKinnon et al. ..... 473/561 |
| 5,429,352 | A | | 7/1995 | Leclerc |
| 5,558,326 | A | | 9/1996 | Adamson et al. |
| 5,697,857 | A | | 12/1997 | Christian et al. |
| 5,836,841 | A | | 11/1998 | Fell |
| 5,839,977 | A | | 11/1998 | Maurer et al. |
| 5,980,404 | A | | 11/1999 | Gentile |
| 6,019,691 | A | | 2/2000 | Hilborn |
| 6,183,383 | B1 | | 2/2001 | McSorley |
| 6,234,923 | B1 | | 5/2001 | Gentile |
| 6,273,835 | B1 | | 8/2001 | Battis et al. |
| 6,364,793 | B1 | | 4/2002 | Valarik |

FOREIGN PATENT DOCUMENTS

| | | |
|---|---|---|
| CA | 984420 | 2/1976 |
| CA | 2244610 | 2/1999 |
| WO | WO 91/02831 | 3/1991 |

* cited by examiner

*Primary Examiner*—Mark S. Graham
(74) *Attorney, Agent, or Firm*—Ronald S. Kosie; BCF LLP

(57) ABSTRACT

A composite hockey stick blade having molded outer surfaces defining a rough surface finish on a portion the outer surfaces. The molded outer surface of the blade adapted to enhance friction between the blade and a puck. The blade may also comprise shock-absorbing elements embedded into the molded outer surfaces of the blade.

1 Claim, 5 Drawing Sheets

B-B

BLADE FOR HOCKEY STICK OR THE LIKE

The present is a divisional of U.S. patent application Ser. No. 09/784,213 filed Feb. 16, 2001 now abandoned and claiming entitlement to priority of U.S. provisional application No. 60/183,159 filed Feb. 17, 2000.

FIELD OF THE INVENTION

The present invention relates to a blade construction for a hockey stick such as a hockey stick for forward players or for goalies and a replacement blade for a hockey stick.

BACKGROUND OF THE INVENTION

Typical hockey stick blades or replacement blades are generally made of a wooden core reinforced with one or more layers of synthetic material such as fiberglass, carbon fiber or graphite and the likes. The core of the blade may also be made of a plastic material reinforced with layers of synthetic fiber material. The reinforcement layer is usually a woven filament sheet, typically soaked in a resin and glued to the outer surfaces of the blade. The blade is strong, stiff and durable. Because of the resin layer surface, the blade has a smooth and hard finish.

To provide the blade with a means for absorbing a portion of the impact of a puck hitting the blade and also to provide a coarser blade surface which will increase the gripping action of the blade on the puck when stick handling, many players add a layer of tape to the blade of the hockey stick. The layer of tape provide a better grip on the puck, absorbs some of the impact when the player performs a slap shot, and also increases the life of the blade by providing a replaceable layer of protection to the hockey stick blade.

However, the layer of tape increases the weight of the blade. Furthermore, it must be replaced regularly as it wears out, thereby increasing the maintenance time the player must dedicate to his or her hockey stick. Also the layer of tape on the bottom surface of the blade impairs the sliding motion of the blade on the ice, hindering the player when shooting and stick handling.

Thus there is a demand for an improved hockey stick blade capable of absorbing some of the impact of a puck and adapted to provide a gripping action on the puck during stick handling.

OBJECTS AND STATEMENT OF THE INVENTION

It is thus an object of the invention to provide a blade for hockey stick adapted for shock absorption.

It is another object of the invention to provide a blade for a hockey stick adapted to provide a gripping action on a puck.

As embodied and broadly described herein, the invention provides a hockey stick blade or replacement blade for the game of ice hockey and the like, the blade comprising a blade portion having two lateral outer surfaces; at least one of the outer surfaces having a molded outer layer defining a rough surface finish on at least a portion of one outer surface, the molded outer layer being adapted to enhance friction between the blade portion and a puck. Advantageously, one of the outer surfaces of the blade further comprises a shock-absorbing element.

As embodied and broadly described herein, the invention provides a hockey stick blade or replacement blade for the game of ice hockey and the like, said blade comprising: a blade portion having two lateral outer surfaces; at least one of the outer surfaces having a shock-absorbing element. The shock-absorbing element is preferably a made of a deformable material such as a rubberized material. Advantageously, the shock-absorbing element is embedded into the outer surface of the blade.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
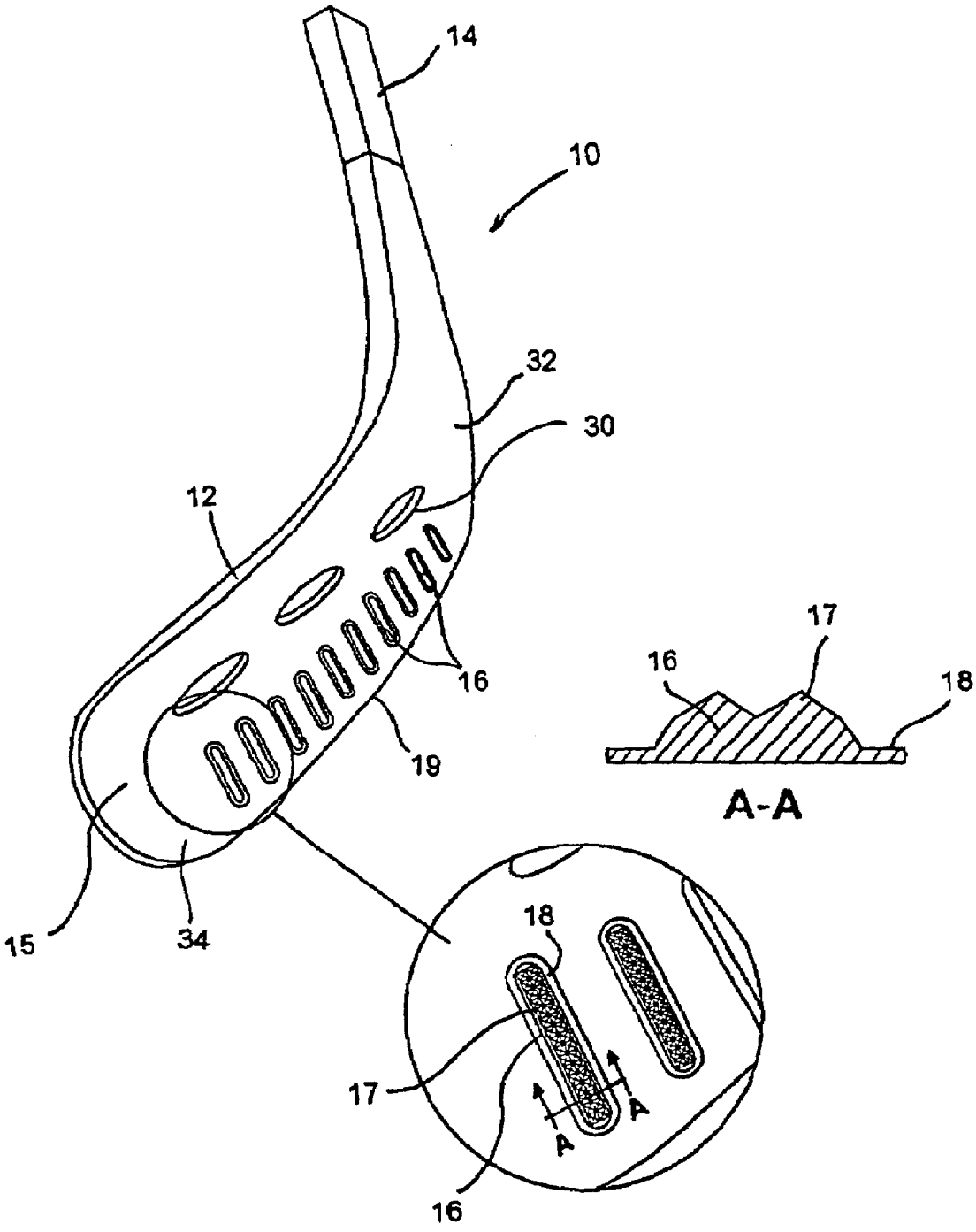
FIG. 1 is a side perspective view of a blade for hockey stick according to one embodiment of the invention with an enlarged view of a portion of the blade and a cross-sectional view of a detail of the enlarged portion.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

FIG. 1 illustrates a replacement blade 10 for a hockey stick. Replacement blade 10 comprises a blade portion 12 and a hosel 14 adapted to be inserted into a hollow hockey stick shaft (not shown). Blade 10 is made of a core having the general shape of the blade enclosed into a molded outer layer. The core of the blade is preferably made of fiberglass, graphite, aramid fiber, foam, rubber or urethane. The core may also be made of laminated wood or metal. The molded outer layer is made of a resin such as epoxy, vinylester or polyester set to conform exactly to the interior surfaces 22 of mold 20 shown in FIG. 2. The molded outer layer made of resin may also be reinforced with any types of fibers. Blade 10 may also be made of a single molded fiber reinforced resin component having outer surfaces conforming to the pattern of interior surfaces 22 of mold 20 shown in FIG. 2. In the present description, blade refers to a replacement blade or a blade which is part of a unitary hockey stick.

The lateral surfaces 15 of blade portion 12 comprise a series of shock-absorbing elements 16 embedded into the molded outer layer of each side of blade portion 12. As a variant, shock-absorbing elements 16 may be located on only one side of blade portion 12. Each shock-absorbing element 16 is made of a rubberized material or other resilient material exhibiting absorbing qualities. Each shock-absorbing element 16 projects above the surface of blade portion 12 by about 1 to 4 mm and preferably 2 mm, such that shock-absorbing elements 16 will be in contact with the puck before surfaces 15. As shown in the enlarged view of FIG. 1 and more specifically in section A—A, shock-absorbing element 16 comprises an uneven central portion 17 projecting above a base 18. Central portion 17 features peaks and valleys to provide a rough surface adapted to adhere to a puck. Central portion 17 is adapted to deform under an impact load thereby absorbing a portion of the impact of a puck.

Figure 5:
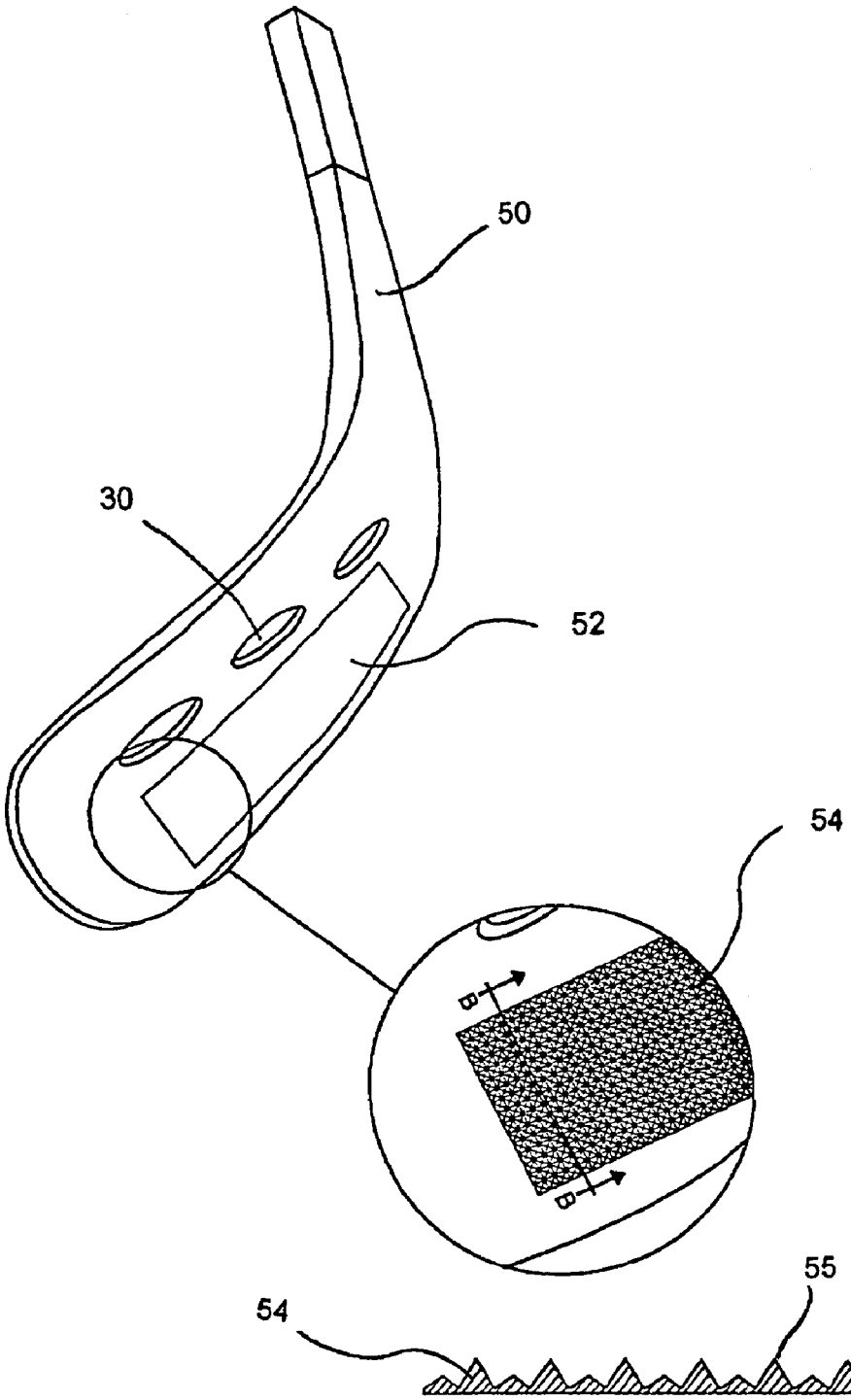
FIG. 5 is a perspective view of a blade for hockey stick according to a further embodiment of the invention with an enlarged view showing the general texture of the surface of the blade for hockey stick.
Figure 5A:
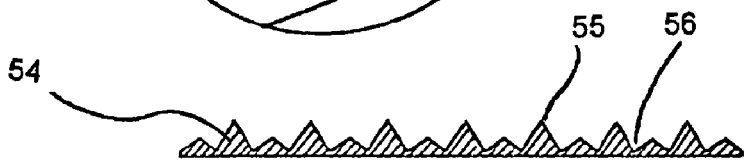
FIG. 5A is a cross-sectional view of the enlarged portion of FIG. 5 taken at line B—B illustrating schematically the relief of the surface of the blade for hockey stick of FIG. 5.

In a preferred embodiment, each shock-absorbing element 16 is shaped like a small bar approximately 35 mm in length positioned vertically relative to the ice contacting edge 19 of blade portion 12. Shock-absorbing elements 16 are spaced apart by about 5 to 25 mm from each other and span a portion of the length or the entire length of blade portion 12. Other configurations and arrangements of the series of shock-absorbing elements 16 are possible such as positioning them at an angle relative to edge 19, positioning them at uneven distance from each other. Furthermore, the shape of the each shock-absorbing element 16 may greatly vary without departing from the spirit and scope of the present invention. Shock-absorbing elements 16 may be square, circular, X-shaped and even a continuous band of rubberized material such as shown in FIG. 5.

Figures 3, 3A:
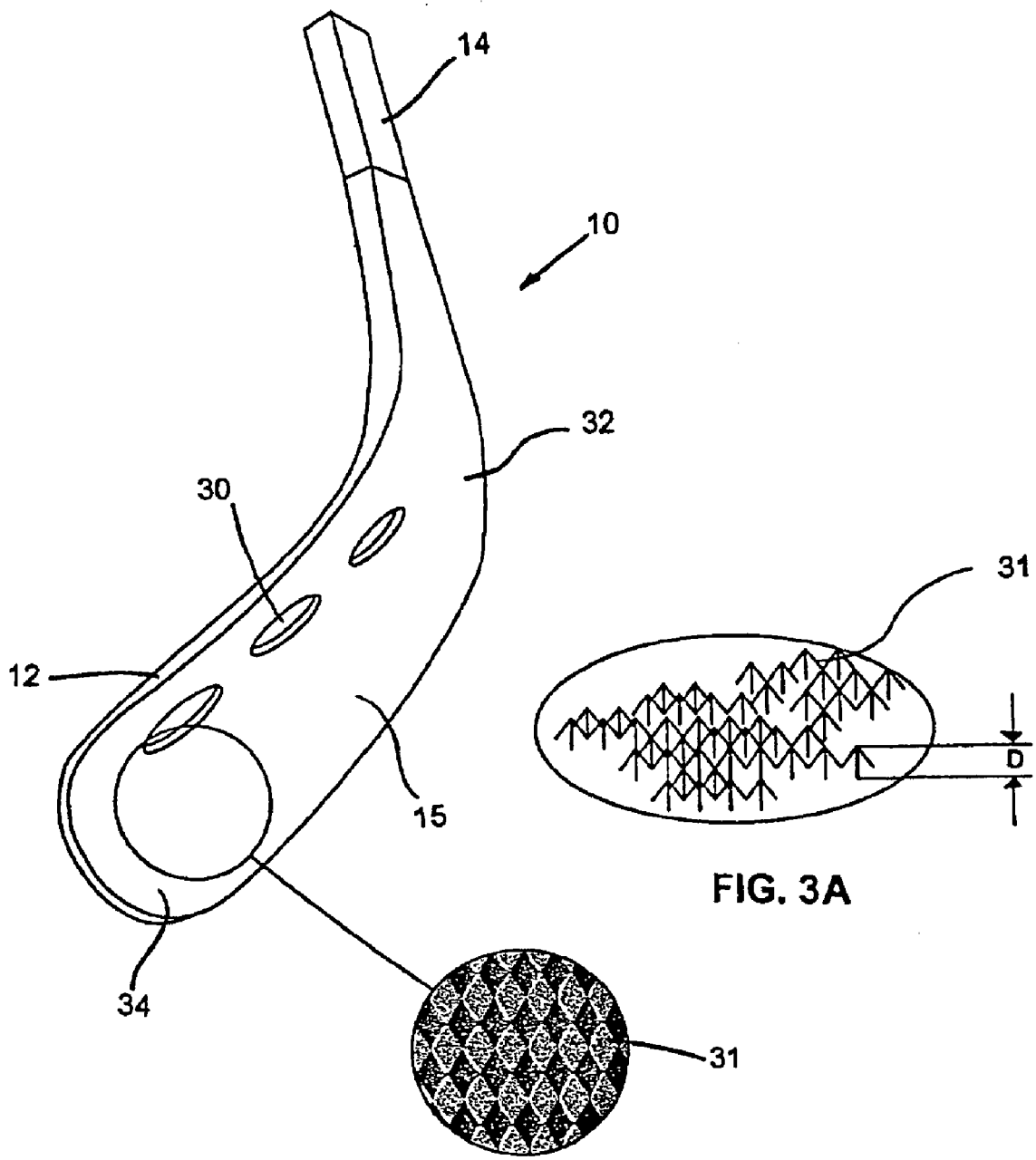
FIG. 3 is a side perspective view of a blade for hockey stick according to one embodiment of the invention with an enlarged view showing the general texture of the surface of the blade for hockey stick.
FIG. 3A illustrates schematically the relief of the surface of the blade for hockey stick according to one aspect of the invention.

Surface 15 of blade portion 12 which surrounds shock-absorbing elements 16 is further provided which a rough surface finish adapted to enhance the friction between blade portion 12 and a puck thereby enhancing the gripping of blade portion 12 to the puck and improving the puck handling quality of blade 10. The outer layer is molded to define a rough surface finish on at least a portion of surface 15 of blade portion 12. As best shown in FIGS. 3 and 3A, preferably, the rough surface finish is a diamond grit texture 31 projecting a distance D in the range of 0.005 to 1 mm and preferably about 0.02 to 0.8 mm. Advantageously, the diamond grit texture or coarse texture is more pronounced at the heel 32 and toe 34 of blade portion 12 and marginally less pronounced in the midsection of blade portion 12. Diamond grit texture 31 typically projects about 0.05 mm at the heel 32 and toe 34 and about 0.025 in the midsection of blade portion 12. Preferably, at least the bottom portion of blade portion 12 includes diamond grit texture 31 from the ice contacting edge 19 to the middle of blade portion 12, a width of about 30 mm.

As a variant, blade portion 12 comprises a series of apertures 30 in the upper portion of blade portion 12. Apertures 30 are air vents adapted to reduce the overall aerodynamic drag of blade portion 12 and help in increasing the velocity of blade 10 when the player is performing a slap shot. Apertures 30 also reduce the overall weight of blade 10. In FIG. 1, blade portion 12 comprises a set of three oblong shaped apertures 30 aligned longitudinally above the series of shock-absorbing elements 16. However, apertures 30 may have any general shape which does not substantially diminish the strength of blade portion 12.

Figure 2:
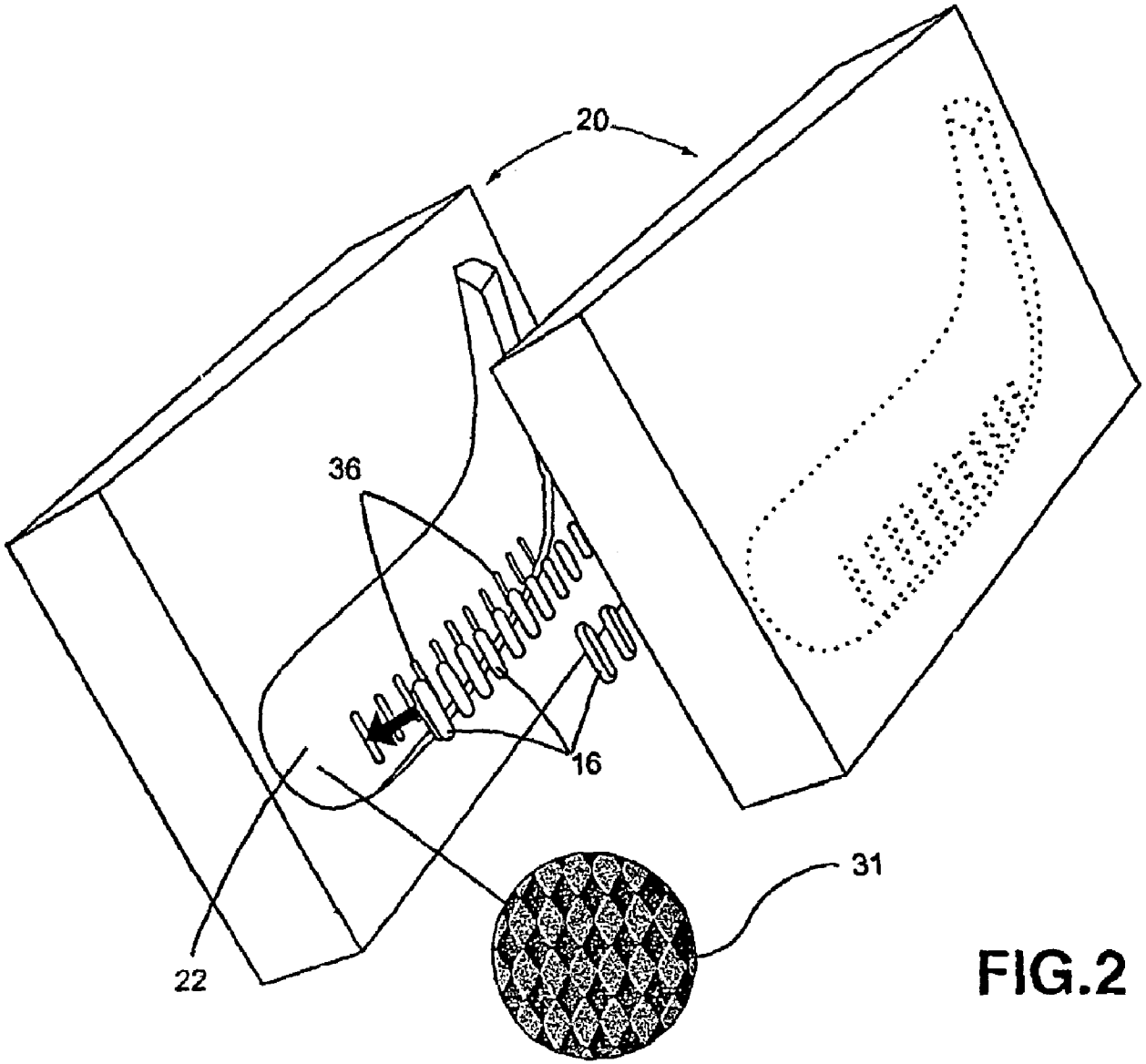
FIG. 2 is a perspective view of a two-part mold to produce the blade for hockey stick of FIG. 1 according to one embodiment of the invention with an enlarged view of the walls of the mold.

FIG. 2 illustrates a two-parts mold 20 adapted to make and produce replacement blade 10. The interior surfaces 22 of mold 20 comprises a diamond grit texture 31 which will give the final shape of a corresponding diamond grit pattern to the outer resin layer making up surfaces 15 of blade portion 12. Furthermore, shock-absorbing elements 16 are inserted into cavities 36 of interior surfaces 22 of mold 20 prior to the molding operation. The depth of cavities 36 determines to height of projection of each shock-absorbing element 16 above the surface of blade portion 12.

The shock-absorbing elements 16 are first inserted into their respective cavities or pockets 36, one or more resin layer, with or without fiber reinforcement, is applied to each side of the mold, then the core of the blade is positioned into one side of the mold. The two-part mold 20 is then closed tightly and heated to accelerate the curing of the outer resin layer. When the resin is cured, the mold is opened and the complete blade 10 is removed. Excess resin and material along the edges of blade 10 are removed with a quick grinding operation. Of course, if apertures 30 are incorporated into blade 10, a series of corresponding projections are included into mold 20 to prevent the resin from entering into the space occupied by apertures 30. This molding operation is generally referred to as compression molding.

Blade 10 may also be constructed without a core. The shock-absorbing elements 16 are inserted into their respective cavities 36, then one or more layer of fiber reinforcement is positioned into mold 20 which is then closed. Resin is injected into mold 20, filling the inside portion of the mold. Mold 20 is then heated to accelerate the curing of the resin. The complete blade 10 is removed displaying outer surfaces 15 which conform to the pattern of interior surfaces 22. This molding operation is generally referred to as resin transfer molding.

As a variant, blade 10 made be a solid piece of molded metal into which is embedded shock-absorbing element 16 and which outer surfaces display a diamond grit pattern adapted to increase friction between the blade and a puck.

Figure 4:
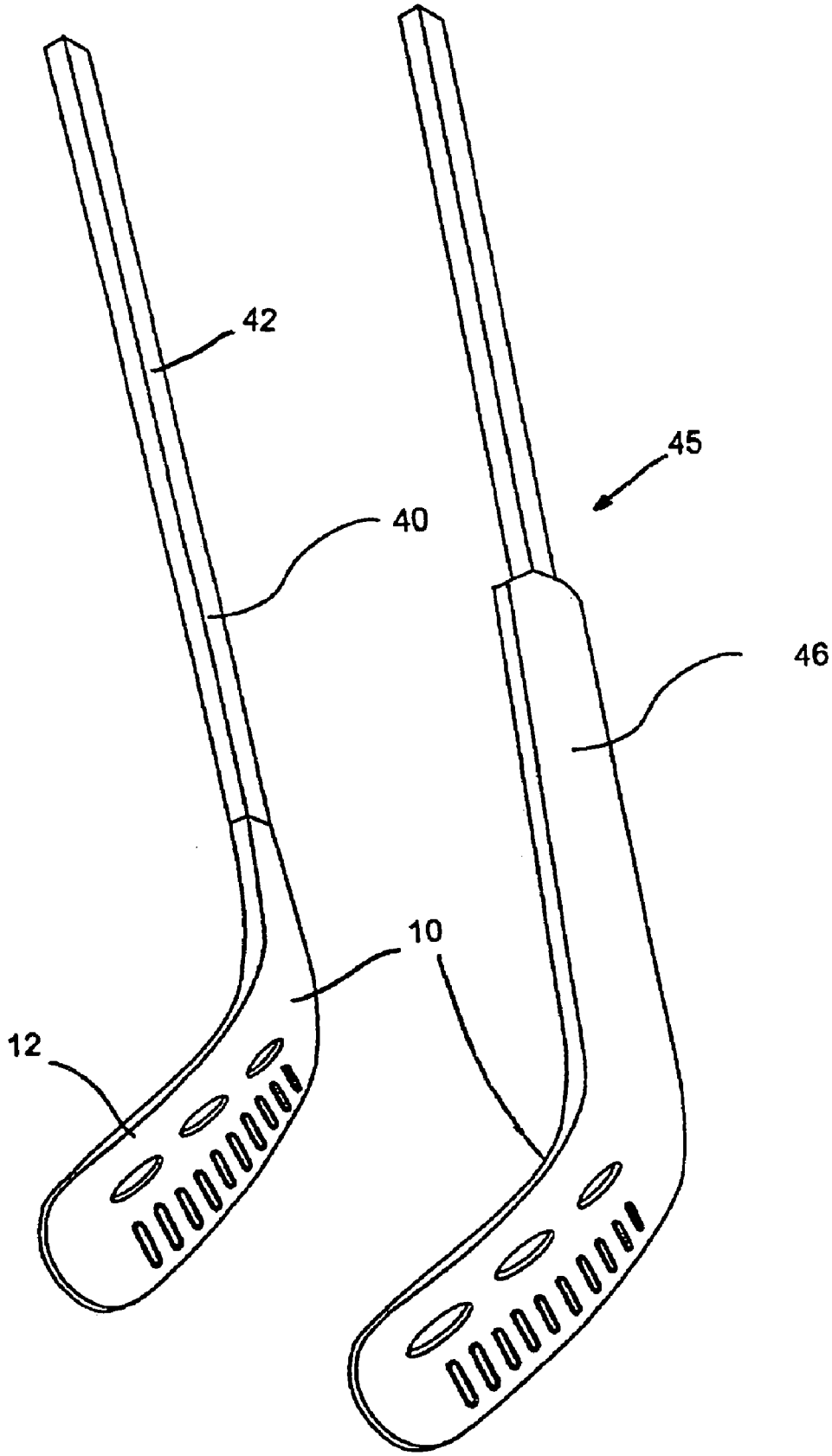
FIG. 4 is a perspective view of a full hockey stick for forward player and of a goaltender, both incorporating a blade according to another embodiment of the invention.

FIG. 4 illustrates a full length hockey stick 40 incorporating a blade 10. Hockey stick 40 may also be constructed using a large mold. Hockey stick 40 may also be constructed using a blade core including a full length shaft 42. The blade is molded in a similar fashion as described with full length shaft 42 protruding out of the mold such that the end result is a one piece hockey stick comprising a composite blade 10 as described. FIG. 4 also illustrates a goaltender hockey stick 45 incorporating an enlarged blade portion 46 essentially constructed in a similar fashion as blade 10. A shaft 47 is connected to the top portion of the large blade portion 46. A hockey stick as referred to in the present description may be interpreted to mean a hockey stick for forward player or for goaltender.

FIG. 5 illustrates a further embodiment of the invention. A replacement blade 50 is made of a core made of laminated wood or any other material reinforced with one or more layer of woven or non-woven fibers soaked in a resin. The exterior surface of blade 50 is provided with a shock-absorbing band 52 either glued to or embedded into the lower portion of the blade 50 as shown in FIG. 5. Blade 50 may also be a single molded fiber reinforced resin component into which is embedded shock-absorbing band 52. Preferably, shock-absorbing band 52 is embedded into the outer surface of blade 50. Shock-absorbing band 52 is made of a rubberized material or any other resilient material exhibiting absorbing qualities. Shock-absorbing band 52 is deformable to absorb impacts and also features a generally rough surface adapted to provide enhance gripping action on a puck.

As shown in the enlarged view of FIG. 5 and more specifically in section B—B, shock-absorbing band 52 preferably includes a diamond grit texture 54 consisting of peaks 55 and valleys 56 providing a generally rough surface adapted to adhere to a puck and adapted to deform under an impact load thereby absorbing a portion of the impact of a puck. Blade 50 may also comprise a set of apertures 30 to reduce overall aerodynamic drag and reduce weight.

The above description of preferred embodiments should not be interpreted in a limiting manner since other variations, modifications and refinements are possible within the spirit and scope of the present invention. The scope of the invention is defined in the appended claims and their equivalents.

I claim:

1. A method of making a hockey stick blade or replacement blade for the game of ice hockey and the like, said blade comprising: a blade portion having two lateral outer surfaces, said blade having at least one shock-absorbing element embedded into said hockey stick blade and projecting from one said lateral outer surface, said method comprising the steps of: Inserting at least one shock-absorbing element into a corresponding cavity of an interior surface of a mold having the general shape of a hockey stick blade; introducing into said mold a material for hardening within said mold; curing said material; opening said mold to remove a hockey stick blade having at least one shock-absorbing element embedded into said hockey stick blade and projecting from one said lateral outer surface.

* * * * *